US012623265B2

(12) United States Patent
Fürst et al.

(10) Patent No.: US 12,623,265 B2
(45) Date of Patent: May 12, 2026

(54) BRIDGING AN INTERRUPTION IN PRODUCTION IN A COMBINED CASTING-ROLLING INSTALLATION

(71) Applicant: Primetals Technologies Austria GmbH, Linz (AT)

(72) Inventors: Heinz Fürst, Gallneukirchen (AT); Simon Grosseiber, Leonding (AT); Thomas Lengauer, Weißkirchen a.d. Traun (AT); Alexander Mayr, Walding (AT); Wolfgang Peitl, St. Florian (AT); Alois Seilinger, Linz (AT)

(73) Assignee: Primetals Technologies Austria GmbH (AT)

( * ) Notice: Subject to any disclaimer, the term of this patent is extended or adjusted under 35 U.S.C. 154(b) by 0 days.

(21) Appl. No.: 18/568,760

(22) PCT Filed: Apr. 27, 2022

(86) PCT No.: PCT/EP2022/061187
§ 371 (c)(1),
(2) Date: Dec. 8, 2023

(87) PCT Pub. No.: WO2022/258254
PCT Pub. Date: Dec. 15, 2022

(65) Prior Publication Data

US 2025/0108420 A1 Apr. 3, 2025

(30) Foreign Application Priority Data

Jun. 9, 2021 (AT) ..... A50468/2021

(51) Int. Cl.
*B21B 1/46* (2006.01)
*B21B 13/22* (2006.01)
*B21B 15/00* (2006.01)

(52) U.S. Cl.
CPC ..... *B21B 1/463* (2013.01); *B21B 13/22* (2013.01); *B21B 15/0007* (2013.01); *B21B 2015/0014* (2013.01)

(58) Field of Classification Search
CPC ..... B21B 1/463; B21B 13/22; B21B 15/0007; B21B 2015/0014; B22D 11/1206; B22D 11/126; B22D 11/14
See application file for complete search history.

(56) References Cited

U.S. PATENT DOCUMENTS 8,453,711 B2 6/2013 Hohenbichler et al.
9,796,006 B2 10/2017 Lengauer et al.

FOREIGN PATENT DOCUMENTS

DE 1905281 A1 8/1970
DE 102008003717 B3 6/2009
(Continued)

OTHER PUBLICATIONS

English Machine Translation of KR20130053110A (Year: 2013).*
(Continued)

*Primary Examiner* — Keith Walker
*Assistant Examiner* — Steven S Ha
(74) *Attorney, Agent, or Firm* — OSTROLENK FABER LLP

(57) ABSTRACT

A method and a device that bridge an interruption in production in a combined casting-rolling installation to provide a combined casting-rolling installation for producing a hot-rolled finished strip, in which, in the case of an interruption, also thick precursor material having a thickness of >30 mm can be separated in a rapid and reliable manner from the next precursor material.

18 Claims, 6 Drawing Sheets

(56) References Cited

FOREIGN PATENT DOCUMENTS

Figure 1:
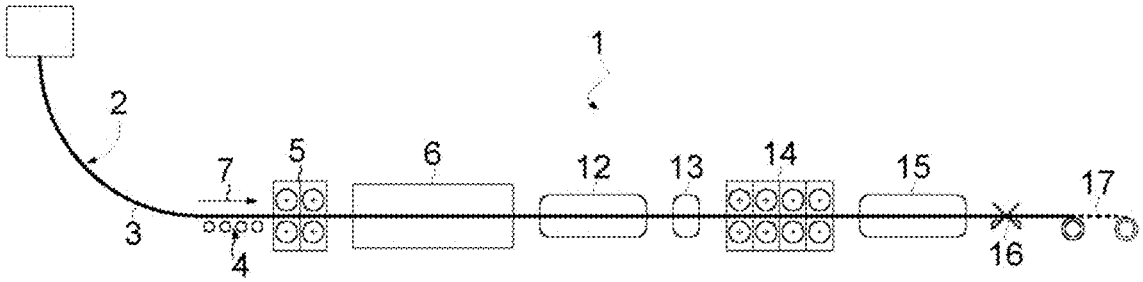
Fig 1 Prior Art

| | | | |
|---|---|---|---|
| DE | 102013213418 | A1 | 2/2014 |
| JP | S55-45530 | A | 3/1980 |
| KR | 2013-0053110 | A | 5/2013 |
| WO | WO 2009/121678 | A1 | 10/2009 |
| WO | WO 2014/029544 | A1 | 2/2014 |
| WO | WO 2015/110648 | A1 | 7/2015 |

OTHER PUBLICATIONS

International Search Report mailed Aug. 1, 2022 in corresponding PCT International Application No. PCT/EP2022/061187.
Office Action mailed Jan. 31, 2026, issued in corresponding Chinese Patent Application No. 202280041446.1. English translation of Chinese Search Report attached.

* cited by examiner

BRIDGING AN INTERRUPTION IN PRODUCTION IN A COMBINED CASTING-ROLLING INSTALLATION

CROSS-REFERENCE TO RELATED APPLICATIONS

The present application is a 35 U.S.C. §§ 371 national stage application of International Application No. PCT/EP2022/061187, filed Apr. 27, 2022, which claims priority to Austrian Patent Application AT A50468/2021, filed Jun. 9, 2021, the contents of which are incorporated herein by reference.

TECHNICAL FIELD

The present invention relates to the technical field of combined casting/rolling installations and the production of a hot-rolled finished strip on a combined casting/rolling installation.

On a combined casting/rolling installation, a strand of an endless starting material, such as a slab or thin slab strand, is continuously cast from liquid molten metal, typically a molten steel, and the strand is subsequently finish-rolled in a finish rolling train to form a hot-rolled finished strip. Continuous operation has proved particularly useful in the production of thin or ultra-thin finished strip, wherein the strand produced in the continuous casting installation is rolled in an uncut state in the finish rolling train to form the finished strip and the finished strip is either cut for the first time either before or after the cooling section.

On the one hand, the present invention relates to a method for the production of a hot-rolled finished strip in a combined casting/rolling installation, wherein in a continuous operation a strand of an endless starting material passes through a facility for cutting and outward conveying at a transport speed in an uncut state, and the starting material is finish-rolled to form the finished strip in a finish rolling train, then cooled, cut and stored.

On the other hand, the invention relates to a combined casting/rolling installation for the production of a hot-rolled finished strip from an endless continuously cast starting material, comprising a continuous casting installation, a facility for cutting and outward conveying, in the material flow direction comprising a first cutter, a lifting apparatus and a clamping roller pair, a multi-stand finish rolling train for finish rolling the starting material to form the finished strip, a cooling section for cooling the finished strip, and a storage facility for outward conveying the finished strip.

PRIOR ART

WO 2009/121678 A1 discloses a combined casting/rolling installation for the production of a hot-rolled finished strip. In the continuous operation, a strand of an endless starting material passes through a facility for cutting and outward conveying at a transport speed in an uncut state, and the starting material is finish-rolled in a finish rolling train to form the finished strip. In order to bridge an interruption in a section of the installation which is downstream of the facility for cutting and outward conveying in the material flow direction, the starting material is first cut, then lifted, the starting material which is following on is cut into scrap pieces, and the scrap pieces are conveyed outward. The starting material that is blocking the downstream section of the installation is then removed from the installation.

Similar methods and similar installations are also known from WO 2014/029544 A1 and DE 10 2013 213 418 A1.

It is not apparent from the prior art how the installation and the method for bridging an interruption in a section of the installation which is downstream of the facility for cutting and outward conveying in the material flow direction, must be modified so that even thick starting material with a thickness >30 mm, preferably ≥45 mm, can be separated quickly and reliably from the starting material which is following on.

SUMMARY OF THE INVENTION

The object of the invention is to modify an existing combined casting/rolling installation for the production of a hot-rolled finished strip from an endless continuously cast starting material as well as an existing method for the production of a hot-rolled finished strip in a combined casting/rolling installation in such a manner that, in the event of an interruption in a section of the installation which is downstream of a facility for cutting and outward conveying in the material flow direction, even thick starting material with a thickness >30 mm, preferably ≥45 mm, can be quickly and reliably separated from the starting material which is following on (for example, from the continuous casting installation or the roughing train).

Investigations by the applicant have shown that in existing combined casting/rolling installations, the lifting apparatus in the facility for cutting and outward conveying would have to be designed extremely large in order to be able to lift starting material with a thickness >30 mm, preferably ≥45 mm. Due to the large design, the lifting beam becomes very heavy and also the hydraulic cylinders become very large in order to lift the starting material so quickly that a collision between the starting material which is blocking the installation and the starting material that is following on from the continuous casting installation or the roughing mill can be reliably prevented. In addition, the volume flow required in order to extend the hydraulic cylinders so quickly also rises sharply, which increases the costs of the hydraulic supply. Finally, the heavy design of the lifting beam greatly increases its mass moment of inertia, which in turn greatly increases the forces and pressures in the hydraulic system.

The method-related aspect of the object according to the invention is solved by a method as claimed. Advantageous embodiments are the subject of the dependent claims.

Specifically, the solution is provided by a method for the production of a hot-rolled finished strip in a combined casting/rolling installation, wherein in a continuous operation a strand of an endless starting material passes through a facility for cutting and outward conveying at a transport speed in an uncut state, and the starting material is finish-rolled in a finishing train to form the finished strip, then cooled, cut and stored, characterized in that the following method steps are carried out in the facility for cutting and outward conveying so as to bridge an interruption in production in a section of the installation which is downstream in the material flow direction:

a) accelerating at least one cutting edge of a first cutter, thereby initiating the cutting of the endless starting material;

b) clamping of the endless starting material by a clamping roller pair, wherein the clamping roller pair are arranged downstream of the first cutter in the material flow direction;

c) lifting of the endless starting material by a lifting apparatus, wherein the lifting apparatus is arranged in the material flow direction between the first cutter and the clamping roller pair;

d) cutting off a strand section from the starting material by the at least one cutting edge of the first cutter;

e) lifting of the strand section by the lifting apparatus;

f) cutting the starting material that is passing the first cutter into scrap pieces by means of the first cutter;

g) Conveying the scrap pieces outward;

h) Removing the strand section until the combined casting/rolling installation is ready for operation again.

In contrast to the methods according to the prior art, the cutting of the endless starting material is first initiated by accelerating at least one cutting edge of the first cutter. The first cutter can be, for example, a rotary cutter, wherein the peripheral speed of the drums must be accelerated to the transport speed of the starting material. Only after the drums have been accelerated can the cut be made. After the cut has been initiated, the endless starting material is clamped by a clamping roller pair. This measure has the effect of "bending" the starting material in the clamping zone of the clamping roller pair, which makes it easier to lift the starting material. Subsequently, the endless starting material is lifted by the lifting apparatus. Typically, the starting material is cut by the first cutter only after the endless starting material is lifted, so that separation occurs between the strand section that is blocking the downstream section of the installation and the starting material that is following on. By cutting the strand section, the tension in the strand section is greatly reduced so that the strand section can be further lifted by the lifting apparatus. The starting material that is following on is cut into scrap pieces by the first cutter, the scrap pieces are conveyed outward and the strand section is removed until the casting/rolling compound installation is ready for operation again.

In order to avoid a collision between the starting material that is following on and the strand section, it is advantageous that the acceleration of the at least one cutting edge of the first cutter, the clamping of the endless starting material and the lifting of the endless starting material are initiated immediately after the occurrence of the interruption in the production, preferably simultaneously.

It is particularly advantageous if the lifting apparatus comprises:

a two-part lifting arm having an inner section and an outer section, wherein the outer section is articulated with respect to the inner section, a lifting actuator for raising the inner section of the lifting arm, and a pivot drive for pivoting the outer section of the lifting arm, wherein as the endless starting material is lifted, the lifting actuator unfolds the inner section of the lifting arm, and wherein as the strand section is lifted, the outer section of the lifting arm is pivoted with respect to the inner section of the lifting arm, thereby further raising the outer section of the lifting arm.

By dividing the lifting arm into two sections, namely an inner section and an outer section, wherein the outer section is arranged upstream of the inner section in the material flow direction when the lifting arm is not raised and the outer section is articulated with respect to the inner section, it is possible when lifting the endless starting material to only unfold the inner section of the lifting arm by means of a lifting actuator. This greatly reduces the force or torque required for the unfolding, so that the lifting actuator can have a thin diameter. Due to the "weak" design of the lifting actuator, it can be extended quickly. During subsequent further lifting of the strand section, the outer section of the lifting arm is pivoted clockwise with respect to the inner section of the lifting arm in a clockwise direction, further lifting the outer section of the lifting arm. When the inner section of the lifting arm is unfolded, the pivot drive is preferably "depressurized" so that the outer section of the lifting arm requires no or negligible additional torque.

It is possible that the lifting of the outer section of the lifting arm is only provided in the case of thin material where more strip storage capacity is needed. In other words, when producing thick starting material (for example with a thickness between 30 and 45 mm), it may be envisaged that when production is interrupted only the inner section is raised and the outer section is preferably kept depressurized.

Typically, after lifting the endless starting material, the inner section of the lifting arm forms an acute angle with the horizontal.

After lifting the strand section, the outer section of the lifting arm is typically aligned parallel to the inner section of the lifting arm.

The apparatus-related aspect of the object of the invention is solved by a combined casting/rolling installation as claimed. Advantageous embodiments are the subject of the dependent claims.

Specifically, the solution provided by a combined casting/rolling installation for the production of a hot-rolled finished strip from an endless continuously cast starting material, comprising:

a continuous casting installation, a facility for cutting and outward conveying, in the material flow direction comprising a first cutter, a lifting apparatus and a clamping roller pair, a multi-stand finish rolling train for finish rolling the starting material to form the finished strip, a cooling section for cooling the finished strip and a storage facility for conveying the finished strip outward, characterized in that the lifting apparatus comprises:

a two-part lifting arm having an outer section and an inner section, wherein the inner section is articulated with respect to a support structure by means of a first joint and the outer section is articulated with respect to the inner section by means of a second joint, a lifting actuator for unfolding the inner section, and a pivot drive for pivoting the outer section in a clockwise direction with respect to the inner section of the lifting arm.

Preferably, the lifting actuator is a first hydraulic cylinder for lifting the inner section of the lifting arm.

Also, the pivot drive is preferably a hydraulic cylinder, called a second hydraulic cylinder, which connects the outer section to the inner section of the lifting arm.

Preferably, the inner section (at about 100° with respect to the outer section) has a mechanical stop so that the outer section moves against a stop during pivoting. This means that the pivot drive can be designed to be particularly short and compact.

In a very compact and therefore advantageous embodiment, the second hydraulic cylinder is arranged substantially parallel to the inner section of the lifting arm.

Preferably, the outer section of the lifting arm comprises at least one, preferably cooled, tube aligned transversely to the material flow direction, wherein the tube is arranged below the starting material when the lifting arm is not raised. In this case, the tube is aligned parallel to the transverse axis of the starting material and has, for example, a horizontal axis of rotation. The tube can be either rigid, in other words non-rotatable, or can be designed as a rotatable roller. The tube is cooled, for example, by a liquid coolant, such as cooling water.

It is advantageous if the first and second joints each have horizontal axes of rotation.

Furthermore, it is advantageous if the second joint is arranged below the starting material when the lifting arm is not raised. As a result, when the lifting arm is raised, the strand section is carried upwards by the tube and the second joint, whereby the foot of the starting material is pulled away from the first cutter.

To facilitate the removal of the scrap pieces, it is advantageous if a lowerable roller table is located below the lifting arm when the lifting arm is not raised. The lowerable roller table can be raised and lowered, for example, by lifting actuators, for example hydraulic cylinders.

It is particularly advantageous if, when the lifting arm is not raised, a measuring roller is located above the passline of the starting material through the facility for cutting and outward conveying. The measuring roller is typically connected to a displacement measuring system for measuring the deflection of the starting material. The measuring roller and the connected displacement measuring system can be used to measure the tension in the starting material so that the tension can be controlled by the electric drives of the stands of the downstream finish rolling train.

SHORT DESCRIPTION OF THE DRAWINGS

Figure 2:
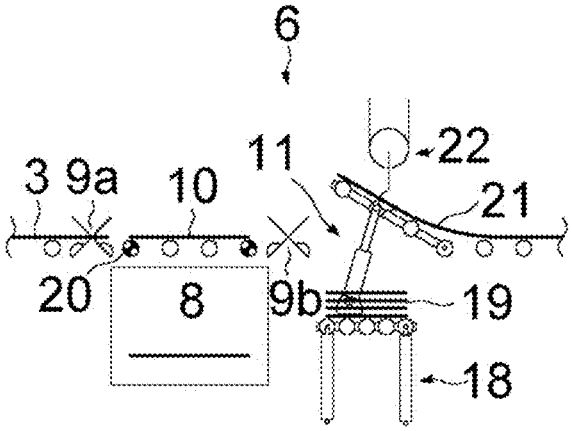
Fig 2 Prior Art

The above described characteristics, features and advantages of this invention and the manner in which these are achieved are more clearly and more precisely understandable in conjunction with the following description of multiple exemplary embodiments that are explained in detail in connection with the drawings. In the drawings:

FIG. 1 shows a plan of a combined casting/rolling installation with a facility for cutting and outward conveying according to the prior art FIG. 2 shows a more detailed illustration of the facility for cutting and outward conveying shown in FIG. 1

Figure 3:
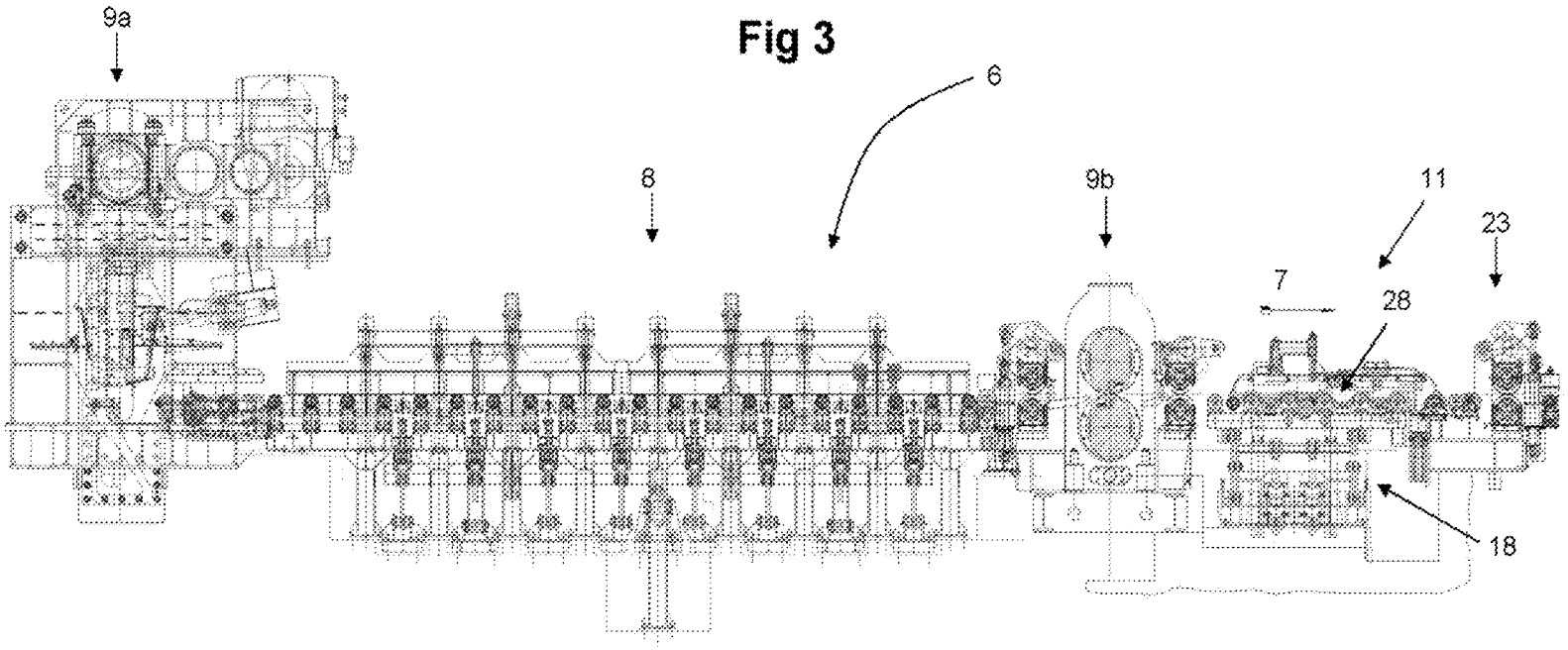
Figure 4A:
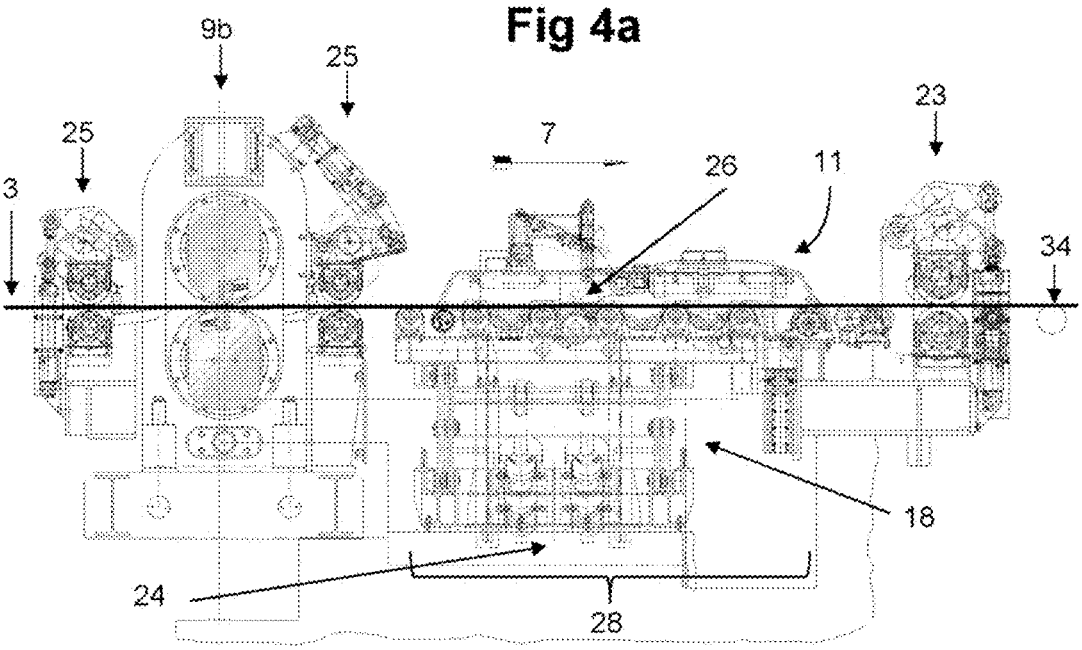
Figure 4B:
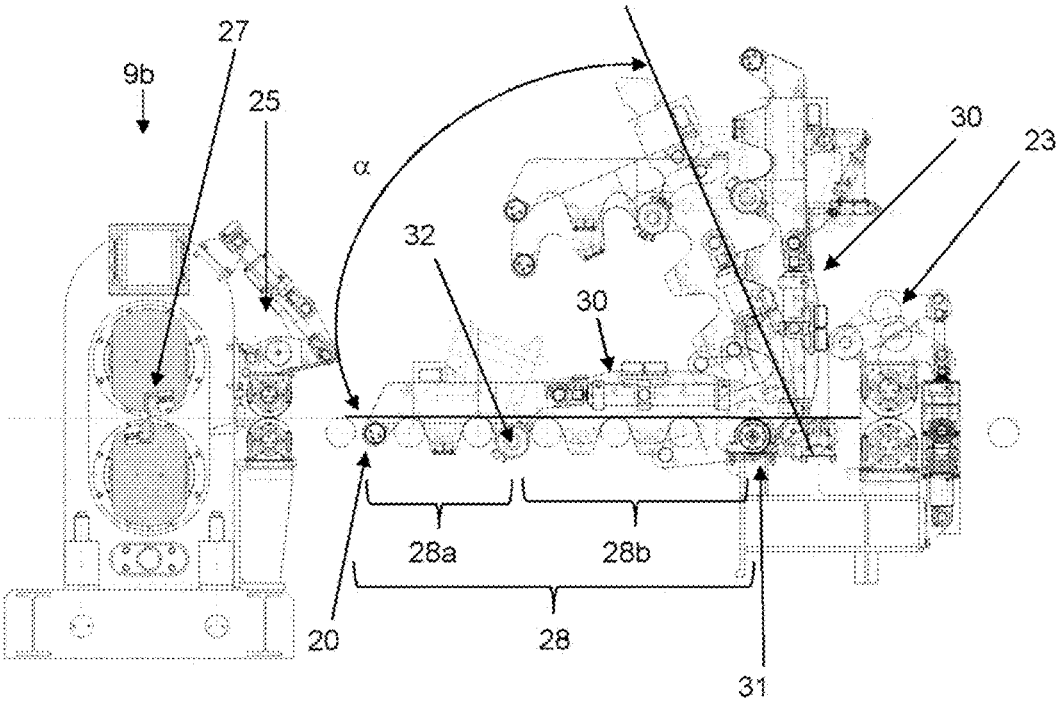
Figure 5:
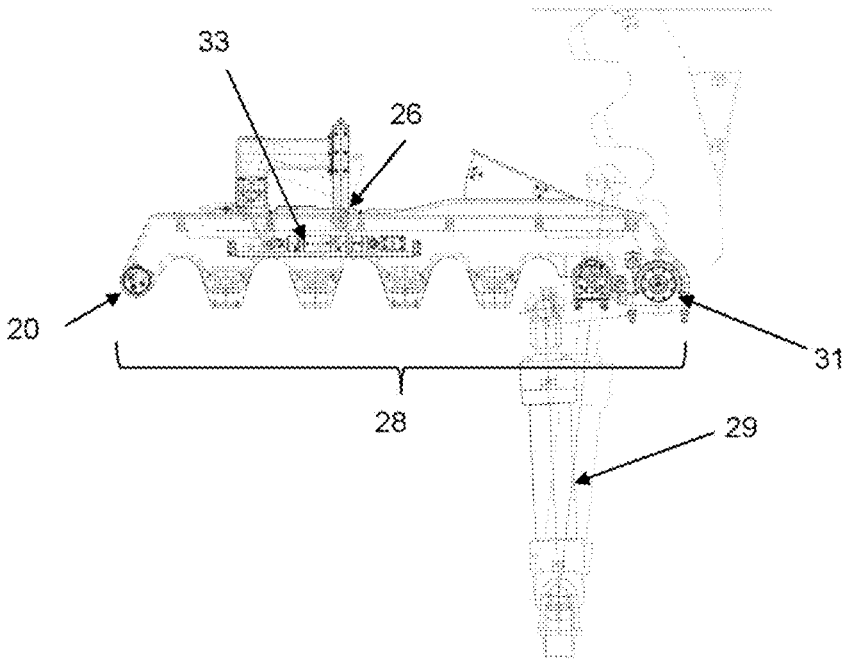
Figure 6A:
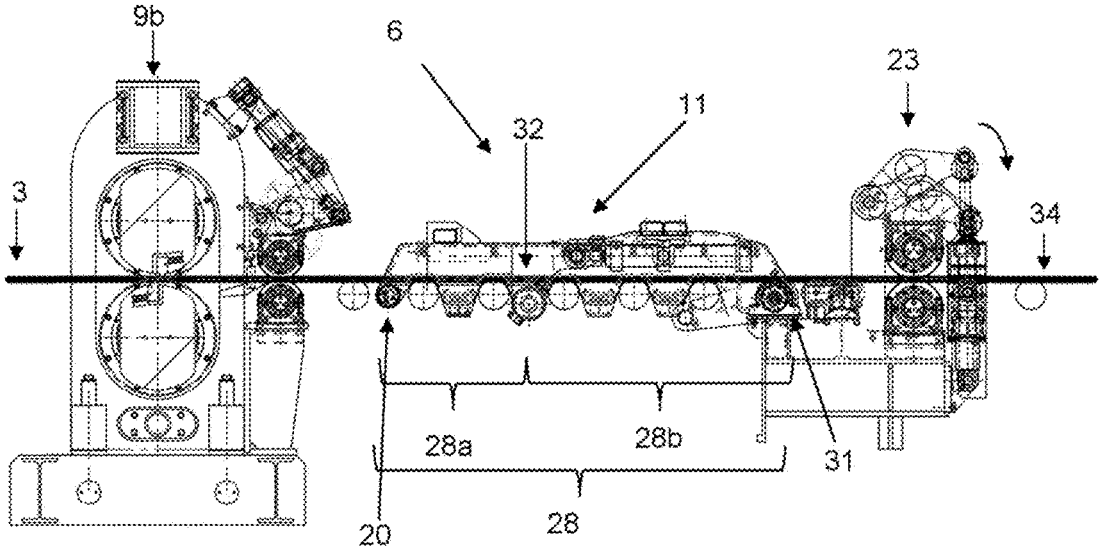

FIG. 3 shows a schematic elevation of a facility for cutting and outward conveying for a combined casting/rolling installation according to the invention FIG. 4*a* shows a detailed representation of the facility for cutting and outward conveying shown in FIG. 3 with the lifting apparatus 11 in the closed state, in other words it is not unfolded FIG. 4*b* shows a detailed representation of the facility for cutting and outward conveying shown in FIG. 3 with the lifting apparatus 11 in the closed, partially raised and fully raised state FIG. 5 shows a representation of the lifting arm of the lifting apparatus shown in FIG. 4*a*, 4*b* in the closed state with the lifting actuator FIG. 6*a* . . . 6*d* show a schematic representation of the different phases during raising of the lifting arm 28 of the lifting apparatus 11 shown in FIGS. 3 to 5.

DESCRIPTION OF THE EMBODIMENTS

FIG. 1 shows a combined casting/rolling installation 1 known from WO 2009/121678 A1 for the production of a hot-rolled finished strip. In this case, a continuous slab or thin slab strand of a continuously cast starting material 3 is produced in a continuous casting machine 2. The starting material 3 is supported, guided and cooled in the arc-shaped strand guide of the continuous casting machine 2, so that the starting material 3 leaves the continuous casting machine 2 in the horizontal transport direction 7 on the roller table 4. The starting material 3 is then pre-rolled in a roughing train 5 and in the continuous operation of the combined casting/rolling installation 1 passes through a facility for cutting and outward conveying 6 in an uncut state, in other words as an endless starting strip. The starting strip is then heated to rolling temperature by a heating section 12 (for example an induction furnace), then descaled and finish-rolled in the finish rolling train 14 to form the finished strip. Following this, the finished strip is cooled in the cooling section 15, then cut by the flying cutter 16 and conveyed out of the casting/rolling compound installation 1 by the storage facility 17, in this case two coilers.

FIG. 2 shows the facility for cutting and outward conveying 6 shown in FIG. 1 in more detail. If a malfunction occurs in a section of the installation downstream of the facility for cutting and outward conveying 6, a strand section 21 is cut off from the endless starting material 3 by the first cutter 9*b* and the strand section 21 is lifted by the lifting apparatus 11. The starting material 3 that follows on from the continuous casting machine 2 or the roughing installation 5 is cut into scrap pieces 19 by the first cutter 9*b*. The scrap pieces 19 can be picked up by a lowerable roller table 18 and are subsequently conveyed out of the installation. In addition, a second cutter 9*a*—in this case a so-called pendulum cutter—can cut off longer sections 10 of starting material and convey them out of the installation by means of an outward conveying facility 8.

FIG. 3 shows a facility for cutting and outward conveying 6 for a combined casting/rolling installation 1 according to the invention. The second cutter 9*a* is a pendulum cutter, whereby sections of starting material 10 can be cut out of the endless starting material 3 and conveyed out of the installation by means of the outward conveying facility 8. The first cutter 9*b*, on the other hand, is a drum cutter with two drums. If a malfunction occurs in a part of the installation downstream of the facility for cutting and outward conveying 6, for example a flyer (usually just called a cobble) in the finish rolling train, or a problem occurs in the cooling section 15 or the storage facility 17, the first cutter 9*b* is accelerated immediately after the interruption in the production is detected, thus initiating the cutting of the endless starting material 3. It should be noted here that the drums of the first cutter 9*b* do not run continuously, but must be accelerated from a standstill. Both drums carry cutting edges for cutting off the starting material 3. Depending on the drive power of the first cutter, the mass moments of inertia of the drums and the transport speed of the starting material 3, the acceleration of the first cutter 9*a* takes a certain time. Thus, the starting material cannot be cut immediately after the interruption in the production is detected. Subsequently, the starting material 3, which is still continuous, is clamped by a clamping roller pair 23. The pair of clamping rollers which can be hydraulically adjusted to the starting material is arranged downstream of the lifting apparatus 11. By clamping the starting material 3, the material is squeezed so that it can subsequently be bent more easily. Subsequently, the endless starting material 3 is lifted by means of the lifting apparatus 11. Typically, a strand section 21 is cut off from the endless starting material 3 only after the starting material 3 has been lifted, whereby the starting material 3 that is following on is separated from the strand section 21. The cutting off is performed by cutting edges 27 of the first cutter 9*b*. When the lifting arm 28 of the lifting apparatus 11 is not raised, a lowerable roller table 18 is arranged below the lifting arm 28.

FIG. 4*a* shows again in more detail the area between the first cutter 9*b* and the clamping roller pair 23 shown in FIG. 3. When the lifting arm 28 is not raised, a measuring roller 26 is arranged above the passline 34 of the starting material 3, which measures the deflection of the starting material 3 by means of a measuring system 33 shown in FIG. 5. The measuring roller 26 and the displacement measuring system 33 can be used to control the main drives of the downstream finish rolling train 14 so that the starting material is almost tension-free in the continuous operation between the roughing mill 5 and the finish rolling train 14.

FIG. 4*b* shows in more detail the different phases during the lifting of the starting material or the strand section. After acceleration of at least one cutting edge of the first cutter 9*b* and the clamping of the endless starting material 3 by the clamping roller pair 23, first only the inner section 28*b* of the lifting arm 28 is raised by means of a lifting actuator 29 (for example a hydraulic cylinder) shown in FIG. 5 from the starting position which is not raised (see also FIG. 6*a*). As a result, the inner section 28*b* of the lifting arm 28 includes an acute angle <90° with the horizontal (see also FIG. 6*b*). The pivot drive 30, which is responsible for pivoting the outer section 28*a* of the lifting arm 28, remains unpressurized during lifting, so that the outer section 28*a* is not collinearly aligned with the inner section 28*b*. This measure dramatically reduces the force or torque required to lift the starting material 3. Typically, after the starting material 3 is cut off by the first cutter 9*b*, the inner section 28*b* of the lifting arm 28 is further raised so that it includes a right angle to the horizontal (see also FIG. 6*c*). Only then is the outer section 28*a* of the lifting arm 28 pivoted by the pivot drive 30 in a clockwise direction so that the outer section 28*a* is aligned collinearly with the inner section 28*b* (see also FIG. 6*d*).

FIG. 5 shows the connection of the lifting actuator 29 to the lifting arm 28 as well as the measuring roller 26 and the displacement measuring system 33.

FIG. 6*a* shows the state of the facility for cutting and outward conveying 6 in the continuous operation of the casting/rolling compound installation. In this case, the lifting arm 28 of the lifting apparatus 11 is not raised and the passline 34 of the starting material 3 runs horizontally. After an interruption in the production has been detected in a section of the installation which is downstream of the facility for cutting and outward conveying 6, the cutting of the endless starting material 3 by means of the first cutter 9*b* is initiated and the clamping roller pair 23 is clamped (see the arrow in the case of the clamping roller pair, which represents the clamping).

Figure 6B:
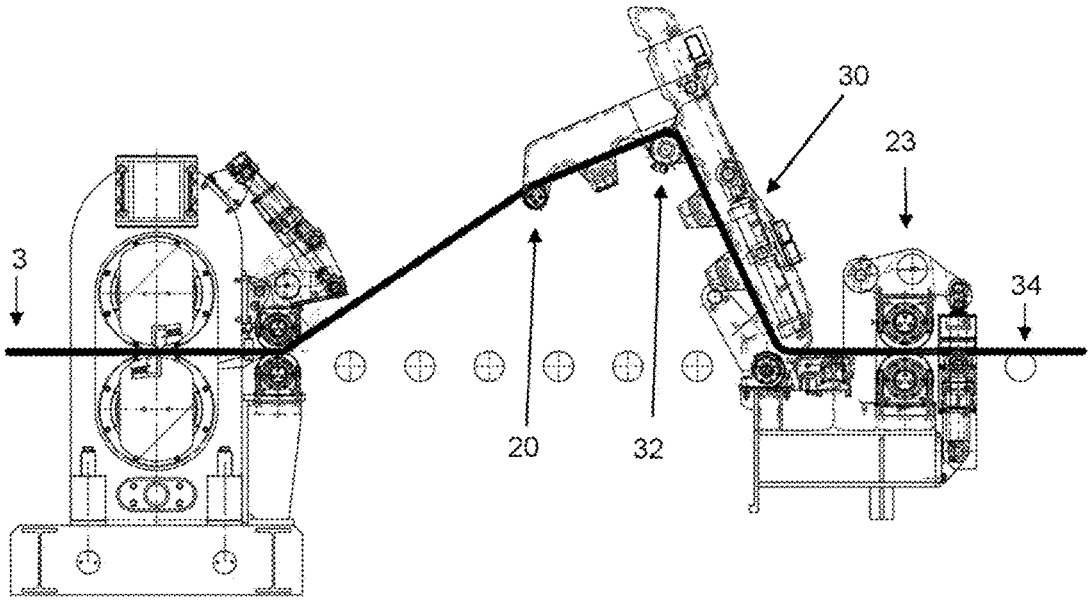

In FIG. 6*b*, the starting material 3 is already clamped by the clamping roller pair 23 and the inner section 28*a* of the lifting arm is raised. Since the starting material 3 is still in an uncut state, the cooled tube 20, which lies below the passline when the lifting apparatus 11 is in the closed state, carries the starting material 3 upwards. The pivot drive 30 is depressurized during the raising so that the outer section 28*a* of the lifting arm is not colinear with the inner section 28*b*.

Figure 6C:
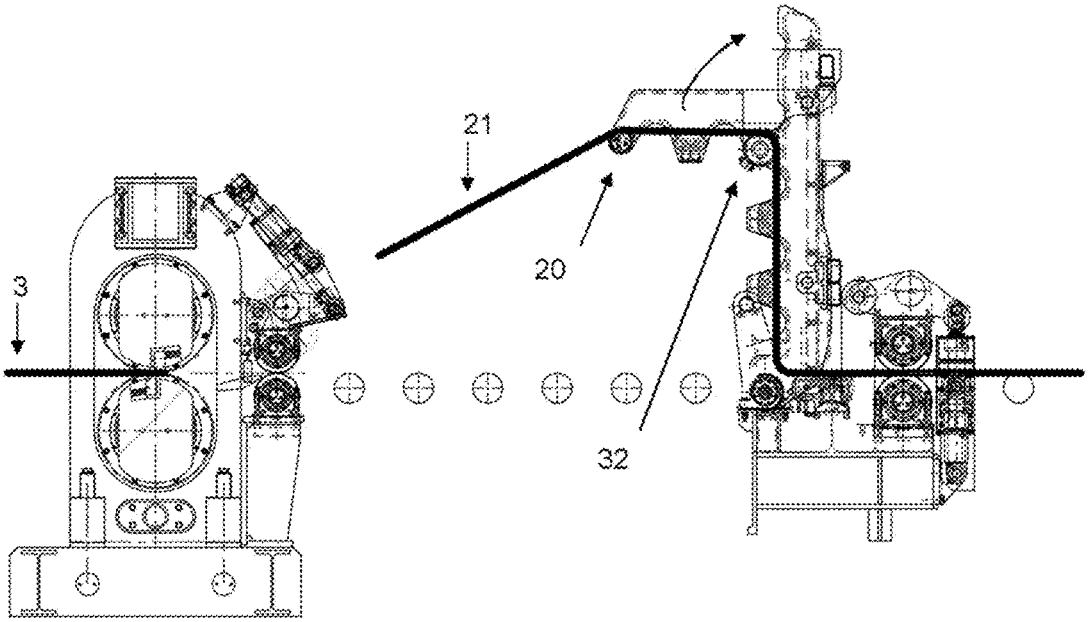

FIG. 6*c* shows the situation after the starting material 3 has been cut off by the first cutter 9*b*. As a result of the cutting, a strand section 21 is cut off from the starting material 3 and said strand section is substantially not tensioned. After the cutting, it is easily possible to completely raise the inner section 28*b* of the lifting arm 28 so that the inner section 28*b* of the lifting arm 28 includes an angle approximately at a right angle to the horizontal.

Figure 6D:
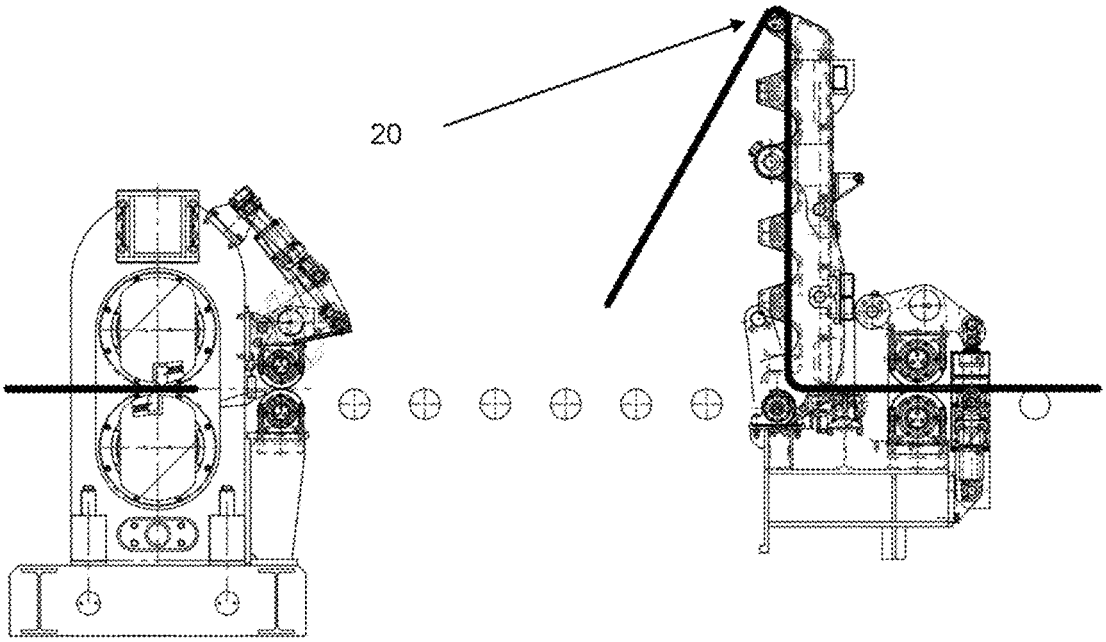

In FIG. 6*d*, the outer section 28*a* of the lifting arm 28 is pivoted by the pivot drive 30 shown in FIG. 6*b* in a clockwise direction so that the outer and inner section 28*a*, 28*b* of the lifting arm 28 are collinearly aligned. As a result, the strand section 21 is raised even further.

Although the invention is further illustrated and described in detail by means of the preferred exemplary embodiments, the invention is not limited by the disclosed examples and other variations may be derived therefrom by the person skilled in the art without abandoning the protective scope of the invention.

LIST OF REFERENCE CHARACTERS

1 Combined casting/rolling installation
2 Continuous casting machine
3 Starting material
4 Roller table
5 Roughing train
6 Facility for cutting and outward conveying
7 Material flow direction
8 Outward conveying facility
9*a* Second cutter
9*b* First cutter
10 Starting material section
11 Lifting apparatus
12 Heating section
13 Descaling installation
14 Finish rolling train
15 Cooling section
16 Flying cutter
17 Storage facilities
18 Lowerable roller table
19 Scrap piece
20 Tube
21 Strand section
22 Crane
23 Clamping roller pair
24 Lifting drive of the lowerable roller table
25 Drive rollers
26 Measurement roller
27 Cutting edge
28 Lifting arm
28*a* 28*b* Outer section and inner section of the lifting arm
29 Lifting actuator
30 Pivot drive
31 First joint
32 Second joint
33 Displacement measuring system
34 Passline
α Angle

The invention claimed is:

1. A method for production of a hot-rolled finished strip in a combined casting/rolling installation, wherein in a continuous operation a strand of an endless starting material passes through a facility for cutting and outward conveying at a transport speed in an uncut state, and the starting material is finish-rolled in a finishing train to form the finished strip, then cooled, cut and stored, wherein the following method steps are carried out in the facility for cutting and outward conveying so as to bridge an interruption in production in a section of the installation which is downstream of a material flow direction:

a) accelerating at least one cutting edge of a first cutter, thereby initiating cutting of the endless starting material;

b) clamping of the endless starting material by a clamping roller pair, wherein the clamping roller pair is arranged downstream of the first cutter in the material flow direction;

c) once the endless starting material is clamped by the clamping roller pair, lifting of the endless starting material to a first height with a rotatable arm of a lifting apparatus by rotating the rotatable arm of the lifting apparatus, wherein the lifting apparatus is arranged in the material flow direction between the first cutter and the clamping roller pair;

d) while the endless starting material is clamped by the clamping roller pair, cutting off a strand section from the starting material by the at least one cutting edge of the first cutter while the endless starting material is at the first height;

e) while the endless starting material is clamped by the clamping roller pair, lifting of the strand section by the lifting apparatus to a second height higher than the first height;

f) cutting the starting material that is passing the first cutter into scrap pieces by means of the first cutter;

g) conveying the scrap pieces outward;

h) removing the strand section until the combined casting/rolling installation is ready for operation again.

2. The method as claimed in claim 1, wherein the acceleration of the at least one cutting edge of the first cutter, the clamping of the endless starting material and the lifting of the endless starting material are initiated immediately after the occurrence of the interruption in the production.

3. The method as claimed in claim 1, wherein the acceleration of the at least one cutting edge of the first cutter, the clamping of the endless starting material and the lifting of the endless starting material are initiated simultaneously and immediately after the occurrence of the interruption in the production.

4. A method for the production of a hot-rolled finished strip in a combined casting/rolling installation, wherein in a continuous operation a strand of an endless starting material passes through a facility for cutting and outward conveying at a transport speed in an uncut state, and the starting material is finish-rolled in a finishing train to form the finished strip, then cooled, cut and stored, wherein the following method steps are carried out in the facility for cutting and outward conveying so as to bridge an interruption in production in a section of the installation which is downstream of a material flow direction:

a) accelerating at least one cutting edge of a first cutter, thereby initiating cutting of the endless starting material;

b) clamping of the endless starting material by a clamping roller pair, wherein the clamping roller pair is arranged downstream of the first cutter in the material flow direction;

c) lifting of the endless starting material by a lifting apparatus, wherein the lifting apparatus is arranged in the material flow direction between the first cutter and the clamping roller pair;

d) cutting off a strand section from the starting material by the at least one cutting edge of the first cutter;

e) lifting of the strand section by the lifting apparatus;

f) cutting the starting material that is passing the first cutter into scrap pieces by means of the first cutter;

g) conveying the scrap pieces outward;

h) removing the strand section until the combined casting/rolling installation is ready for operation again, wherein the lifting apparatus comprises:

a two-part lifting arm having an inner section and an outer section, wherein the outer section is articulated with respect to the inner section, a lifting actuator for raising the inner section of the lifting arm, and a pivot drive for pivoting the outer section of the lifting arm, wherein as the endless starting material is lifted, the lifting actuator unfolds the inner section of the lifting arm, and wherein as the strand section is lifted, the outer section of the lifting arm is pivoted with respect to the inner section of the lifting arm in a clockwise direction, thereby further raising the outer section of the lifting arm.

5. The method as claimed in claim 4, wherein after lifting the endless starting material the inner section of the lifting arm includes an acute angle a from horizontal.

6. The method as claimed in claim 4, wherein after lifting the strand section the outer section is aligned parallel to the inner section of the lifting arm.

7. The method as claimed in claim 4, wherein after lifting the endless starting material the inner section of the lifting arm includes an acute angle a that is less than 90° from horizontal.

8. A combined casting/rolling installation for the production of a hot-rolled finished strip from an endless continuously cast starting material, comprising:

a continuous casting installation, a facility for cutting and outward conveying in a material flow direction comprising a first cutter, a lifting apparatus and a clamping roller pair, a multi-stand finish rolling train for finish rolling the starting material to form the finished strip, a cooling section for cooling the finished strip, and a storage facility for conveying the finished strip outward, wherein the lifting apparatus comprises:

a two-part lifting arm having an inner section and an outer section, wherein the inner section is articulated with respect to a support structure by means of a first joint and the outer section is articulated with respect to the inner section by means of a second joint, a lifting actuator for unfolding the inner section, and a pivot drive for pivoting the outer section in a clockwise direction with respect to the inner section of the lifting arm.

9. The combined casting/rolling installation as claimed in claim 8, wherein the lifting actuator is a first hydraulic cylinder for raising the inner section of the lifting arm.

10. The combined casting/rolling installation as claimed in claim 8, wherein the pivot drive is a second hydraulic cylinder which connects the outer section to the inner section of the lifting arm.

11. The combined casting/rolling installation as claimed in claim 10, wherein the second hydraulic cylinder is arranged substantially parallel to the inner section of the lifting arm.

12. The combined casting/rolling installation as claimed in claim 8, wherein the outer section of the lift arm comprises at least one tube aligned transversely to the material flow direction, wherein the at least one tube is arranged below the starting material when the lifting arm is not raised.

13. The combined casting/rolling installation as claimed in claim 8, wherein the first joint and the second joint have horizontal axes of rotation.

14. The combined casting/rolling installation as claimed in claim 13, wherein the second joint is arranged below the starting material when the lifting arm is not raised.

15. The combined casting/rolling installation as claimed in claim 8, wherein when the lifting arm is not raised a lowerable roller table is located below the lifting arm.

16. The combined casting/rolling installation as claimed in claim 8, wherein when the lifting arm is not raised a measuring roller is located above a passline of the starting material through the facility for cutting and outward conveying.

17. The combined casting/rolling installation as claimed in claim 16, wherein the measuring roller is connected to a displacement measuring system for measuring a deflection of the starting material.

18. The combined casting/rolling installation as claimed in claim 8, wherein the outer section of the lift arm comprises at least one cooled tube aligned transversely to the material flow direction, wherein the at least one cooled tube is arranged below the starting material when the lifting arm is not raised.

* * * * *